United States Patent [19]

Alneng

[11] Patent Number: 4,461,520

[45] Date of Patent: Jul. 24, 1984

[54] ELONGATE DRAWER WITH COMPARTMENTS FOR SLIDING MOUNTING IN CUPBOARDS, CHESTS OF DRAWERS, RACKS OR THE LIKE

[76] Inventor: Carl-Göran Alneng, Robertsviksvägen 16, S-182 35 Danderyd, Sweden

[21] Appl. No.: 307,788

[22] Filed: Oct. 2, 1981

[30] Foreign Application Priority Data

Oct. 27, 1980 [SE] Sweden ..... 8007541

[51] Int. Cl.[3] ..... A47B 88/00; A47B 95/02

[52] U.S. Cl. ..... 312/330 R; 312/244; 312/DIG. 33; 206/558; 211/128; D6/510; D6/446

[58] Field of Search ..... 312/330 R, 209, DIG. 33, 312/229, 244; 211/52, 55, 53, 128, 49 D; 206/557, 558, 561; D6/186, 189; 16/110 R, 110 A, 110.5, 124

[56] References Cited

U.S. PATENT DOCUMENTS

| | | | |
|---|---|---|---|
| D. 108,321 | 2/1938 | Erickson | D6/186 |
| D. 130,415 | 11/1941 | Pitner et al. | D6/189 |
| D. 201,332 | 6/1965 | Caldwell | D6/189 |
| D. 223,681 | 5/1972 | Whitaker | 206/558 |
| D. 262,928 | 2/1982 | Medders | D6/189 |
| 853,215 | 5/1907 | Berg | 211/128 |
| 1,063,894 | 6/1913 | Smith | 206/558 |
| 1,267,377 | 5/1918 | Chilstrom | 211/55 |
| 1,936,951 | 11/1933 | Peterson | 206/557 |
| 3,524,553 | 8/1970 | Zitmore | 211/128 |
| 4,232,916 | 11/1980 | Correia | 312/111 |
| 4,269,461 | 5/1981 | Roach, Jr. | 312/244 |

FOREIGN PATENT DOCUMENTS 338455 8/1977 Austria .

*Primary Examiner*—Victor N. Sakran

*Attorney, Agent, or Firm*—McAulay, Fields, Fisher, Goldstein & Nissen

[57] ABSTRACT

An elongate drawer (2), (FIG. 1) is slidably mounted in a chest of drawers (1) and has compartments for storing small objects, particularly packed goods for drugstores and the like. The bottom of the drawer is formed from two longitudinal halves (3*a*,3*b*), which are united along the longitudinal central line (4) of the drawer bottom, to slope from there towards the longitudinal sides (5,6) of the drawer, there being a vertical spinal wall (7) attached to the longitudinal halves (3*a*,3*b*) along the longitudinal central line (4) to divide the drawer (2) in its longitudinal direction into two spaces with vertical compartment walls (8).

3 Claims, 4 Drawing Figures

ELONGATE DRAWER WITH COMPARTMENTS FOR SLIDING MOUNTING IN CUPBOARDS, CHESTS OF DRAWERS, RACKS OR THE LIKE

BACKGROUND OF THE INVENTION

The present invention relates to an elongate drawer intended for slidably mounting in cupboards, chests of drawers, racks or the like, to store small objects, especially pharmaceutical packaged goods in drugstores, pharmacies or the like.

PRIOR PATENT DISCLOSURE

In drugstores it is known to keep pharmaceutical goods in relatively large and high chests of drawers with elongate, pull-out drawers, which have a horizontal bottom and compartments for the goods. The contents of an open drawer are difficult to see, particularly with those drawers which are above the height of a person's eyes. It has therefore also been proposed to allow the drawer bottom to slope towards one long side of the drawer, e.g. according to the Austrian Pat. No. 338 455. To view, and take out goods from such an open drawer it is necessary to place oneself at the lowest long side of the drawer, and therefore perhaps having had to move from the long side of the drawer uppermost. Furthermore, special guides must be provided for the drawers, and their bottoms must be relatively sturdy to have sufficient carrying strength when the drawers are pulled out, thus making the drawers clumsy. On the other hand, the earlier drawers with a horizontal bottom can have a thin bottom, but then the side walls of the drawer must be relatively sturdy and rigidly connected to the bottom to give the drawer the required carrying strength. Such side walls also increase the total weight of the drawer and hide the goods.

OBJECT AND SUMMARY OF THE INVENTION

The present invention has the objects of avoiding the abovementioned drawbacks and to provide a sliding drawer with compartments for the goods, so that these are easily accessible at both long sides of the drawer and that the drawer can sustain the load, even when it has a thin bottom.

This object is achieved in accordance with the present invention, whereby a sliding drawer is provided with characterizing features disclosed in the accompanying claims.

BRIEF DESCRIPTION OF THE DRAWING

The invention is illustrated by means of an embodiment shown on the appended drawing, where.

DISCLOSURE OF BEST MODE

Figure 1:
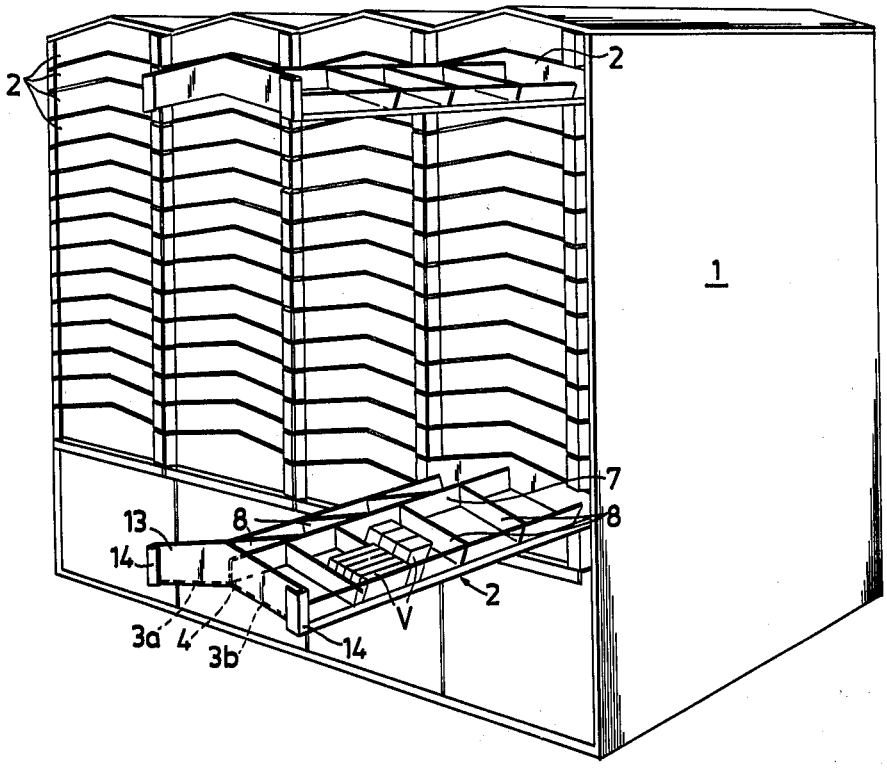
FIG. 1 is a schematic perspective view of a chest of drawers provided with drawers in accordance with the invention.

The chest of drawers illustrated in FIG. 1 carries a plurality of elongate sliding drawers 2, the bottoms of which are formed from two relatively thin long halves 3*a* and 3*b*. These halves are joined along a longitudinal central line 4, and each slopes towards the respective long edge 5,6 of the drawer, so that the halves 3*a*,3*b* mutually form an obtuse. A vertical spinal wall 7 is suitably rigidly joined to the bottoms along the line 4, compartment walls 8 extending at right angles from the wall 7 on each of the halves 3*a*,3*b*.

Figure 2:
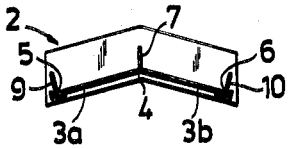
FIG. 2 is a vertical section through a drawer in accordance with the invention.

A side wall 9,10 is juxtaposed alongside the respective long edge 5,6 of the drawer bottom (see FIG. 2), said side wall suitably being of transparent material such as plastics, and disposed as a stop for the goods V (see FIG. 1) which are put into the compartments separated by the spinal wall 7 and walls 8, as illustrated by the pulled-out lower drawer 2 in FIG. 1.

Figure 3:
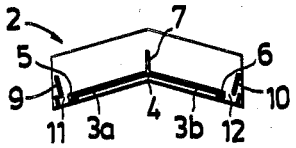
FIG. 3 is also a vertical section through a drawer, but having a somewhat modified embodiment.

FIG. 3 shows the side walls 9,10 mounted at a minor distance from the long edges 5,6, to form gaps 11 and 12 to prevent the collection of dust or the like in this region.

Figure 4:
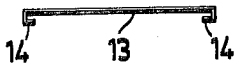
FIG. 4 is a plan view from above of the drawer front.

The vertical front wall 13 of the drawer 2 has its upper end lower edges parallel to the plan of the bottom halves 3*a*,3*b* in FIG. 1, and according to FIGS. 1 and 4 it has bent inwardly side edges to form handles and grips for a pair of fingers for pulling out the drawer.

The guides allowing the drawer to slide form no part of this invention, and can consist of known guide rails or strips with gliding or rolling means.

The embodiment in accordance with the invention has the particular advantages that, even in its open position and independent of its longitudinal side walls or guides, the drawer has in itself high stability against vertical bending stresses by having the bottoms comprise two longitudinal halves 3*a*,3*b*, mutually forming an angle with an upwardly directed apex forming a stiffening spine in the longitudinal direction, and this stability can be increased by the vertical partition wall 7 being rigidly united to said spine. It is not necessary to station oneself at a given long side of the drawer to take goods from an open drawer, and a person can be at either longitudinal side and take out goods, since the same kind of goods is suitably placed in the compartments on either side of the partition wall 7.

It should be clearly understood that the invention is not limited to the specific embodiments described and illustrated on the drawing, but includes all other modifications falling within the scope of the invention. For example, the embodiment with the bottom sloping in opposite directions and at right angles to the sliding direction of the drawer is applicable independent of the depth of the drawer relative to its width. The angle between the longitudinal halves can be varied, and the stop means along the long edges of the drawer can have different embodiments, which also applies to the handles on the drawers. The longitudinal bottom halves do not need to be in the shape of solid sheets, but can be in the form of sturdy grating structures or the like.

I claim:

1. An elongated drawer adapted for slidably fitting in a chest of drawers and the like and having a plurality of compartments;

said drawer having a sloping bottom in its transverse direction between lateral vertical edges;

said bottom being formed from two longitudinal halves;

said halves being joined along the longitudinal central line of said bottom and sloping outwardly towards said lateral edges to form an obtuse angle with an upwardly directed apex;

a vertical spinal partition wall rigidly secured along said apex;

compartment walls extending from said partition wall to said lateral edges to form compartments in said drawer and, a vertical front wall with inwardly bent side edges forming handles.

2. An elongated drawer adapted for slidably fitting in a chest of drawers and the like and having a plurality of compartments;

said drawer having a sloping bottom in its transverse direction between lateral vertical edges;

said bottom being formed from two relatively thin long longitudinal halves;

said halves being joined along the longitudinal central line of said bottom and slope outwardly towards said apex;

a vertical spinal partition wall rigidly secured along said apex;

compartment walls extending from said partition wall to said lateral edges to form compartments in said drawer;

a transparent side wall juxtaposed alongside each lateral edge to form a stop for articles in said compartment;

and a vertical front wall with inwardly bent side edges forming handles.

3. A elongated drawer adapted for slidably fitting in a chest of drawers and the like and having a plurality of compartments; comprising, in combination, said drawer having lateral vertical edges and a sloping bottom in its transverse direction between said lateral vertical edges;

said bottom being formed from two longitudinal halves;

said halves being joined along the longitudinal central line of said bottom and sloping outwardly towards said lateral edges to form an obtuse angle with an upwardly directed apex;

a vertical spinal partition wall rigidly secured along said apex;

compartment walls extending from said partition wall to said lateral edges to form compartments in said drawer;

a transparent side wall juxtaposed alongside each lateral edge to form a stop for articles in said compartments; said side wall being mounted in spaced relation from said lateral edges to form a gap therebetween; and a vertical front wall with inwardly bent side edges forming handles.

* * * * *